United States Patent [19]

Emery et al.

[11] Patent Number: 4,782,995

[45] Date of Patent: Nov. 8, 1988

[54] EGG CARTON

[76] Inventors: Roy W. Emery, 1 Donino Ct., Toronto, Ontario, Canada, M4N 2H6; John R. Emery, 83 Ames Circle, Don Mills, Ontario, Canada, M3B 3C2

[21] Appl. No.: 771,479

[22] Filed: Sep. 3, 1985

Related U.S. Application Data

[63] Continuation of Ser. No. 551,189, Nov. 14, 1983, abandoned.

[51] Int. Cl.[4] ..... B65D 85/32

[52] U.S. Cl. ..... 229/2.5 EC; 229/2.5 R

[58] Field of Search ..... 229/44 EC, 45 EC, 2.5 EC, 229/44 R, 45 R, 2.5 R; 206/815

[56] References Cited

U.S. PATENT DOCUMENTS

| | | | |
|---|---|---|---|
| 2,873,057 | 2/1959 | Friday | 229/45 EC |
| 2,970,734 | 2/1961 | Heath | 229/45 EC |
| 3,000,528 | 9/1961 | Kuhl et al. | 229/2.5 EC |
| 3,217,963 | 11/1965 | Alsman | 229/45 EC |
| 3,655,110 | 4/1972 | Eisenbach | 229/2.5 EC |
| 3,672,693 | 6/1972 | Weir | 229/44 EC |
| 3,749,235 | 7/1973 | Boursier | 229/2.5 EC |
| 3,771,712 | 11/1973 | Richards | 229/2.5 EC |
| 4,059,219 | 11/1977 | Reifers et al. | 229/2.5 EC |
| 4,383,638 | 5/1983 | Bixler | 229/44 EC |
| 4,463,894 | 8/1984 | Daines | 229/44 EC |

FOREIGN PATENT DOCUMENTS

| | | | |
|---|---|---|---|
| 2025370 | 1/1980 | United Kingdom | 229/45 EC |
| 2106477 | 4/1983 | United Kingdom | 229/2.5 EC |

*Primary Examiner*—Stephen Marcus
*Assistant Examiner*—Gary E. Elkins
*Attorney, Agent, or Firm*—Fetherstonhaugh & Co.

[57] ABSTRACT

A moulded container for frangible articles comprising a tray formed with rows of cavities, a cover hinged to the tray along a hinge line, the cavities being of lesser cross section adjacent their bottom than their top whereby the outside walls of the adjacent cavities merge in hollow posts therebetween, said tray having a continous rim along its front edge, said cover having a continuous rim along its front edge, the continuous rim of the cover meeting the continuous rim of the tray when the cover is closed upon the tray, at least one of said hollow posts adjacent the front edge of the tray being a locking post, said locking post extending above the front rim of the tray and having side walls that merge with said rim of said tray, a front face that slopes rearwardly of the rim, and a catch opening formed in its front face, said lid being formed with an inwardly extending latch adapted to underlie the upper edge of said catch opening of said locking post and a support lip adapted to overlie the top of said locking post when the cover is closed upon the tray, the latch and support lip being separated by an opening formed in the front face of the cover.

12 Claims, 3 Drawing Sheets

EGG CARTON

This application is a continuation of application Ser. No. 551,189, filed Nov. 14, 1983.

This invention relates to a container for frangible articles such as eggs that is manufactured by a moulding process such as pulp moulding.

The prime requirement of such a container is that it be capable of safely holding, during transit, the frangible articles for which it is designed, of conveniently presenting the articles for use by the consumer, and of supporting a top loading of a stack of like containers and their contents. The moulded pulp egg container of standard design has performed these functions very well for over 30 years and it continues to do so. During that period of time modifications in design have been made, but the basics of the container in practice have remained the same.

U.S. Pat. No. 3,645,436 dated Feb. 29, 1972 to James W. Boyd et al is an illustration of the basic type of container referred to. It has a tray formed with rows of cavities to receive eggs, a cover hinged to the tray along a hinge line and a locking flap hinged to the front edge of the tray. In use, the locking flap is folded inwardly and the cover is caused to extend over the tray and over the locking flap. Interlocking formations on the locking flap and the cover engage as the cover is closed to secure the cover in place. The interlocking formations can be manually released by the consumer to gain access to the container.

As one may well expect, competition in the manufacture of a container as well established as the container of this general type is very keen. The equipment to manufacture the containers is costly and manufacturing competence depends upon getting maximum production from the equipment because the capital cost of the equipment is a major factor in the pricing of the container.

These containers are moulded side by side in rows, each with the cover, the tray and the locking flap aligned with their principal planes in a common or in parallel planes. Thus, the combined width of the cover, the tray and the locking flap represents an important dimension of the moulding area required for the purpose of moulding each container.

If one could eliminate the locking flap from the container, one would substantially reduce the width of the moulding area required for the container as it is moulded and thus increase the number of such containers which could be moulded in a row of the same width, because the with of each container would be only the combined width of the tray and the cover.

Various attempts to eliminate the locking flap by incorporating the releaseable locking means on the tray and cover have been attempted over the years and examples of such attempsts are to be found in prior U.S Pat. Nos. 3,217,963 dated Nov. 16, 1965 to E. M. Alsman; 3,258,186 dated June 28, 1966 and 3,749,235 dated July 31, 1973 to Boursier. These relate to egg cartons. They avoid the locking flap but the latch of the latch and catch arrangement is on the tray. To incorporate the latch on the tray means that the customary rim at the front edge of the tray must be discontinuous at the latch formation. The result is a container that lacks practical rigidity.

It is an object of this invention to provide a construction for an economically produceable moulded container for frangible articles such as eggs that fulfills the requirements of utility for such a container and that does not involve the use of a locking flap and that has a tray portion that is rigid along its front edge.

A moulded container for frangible articles according to the present invention comprises a tray formed with rows of cavities; a cover hinged to the tray along a hinge line, the cavities being of lesser cross section adjacent their bottom than their top whereby the outside walls of the adjacent cavities merge in hollow posts therebetween; said tray having a continuous rim along its front edge; said cover having a continuous rim along its front edge, the continuous rim of the cover meeting the continuous rim of the tray when the cover is closed upon the tray; at least one of said hollow posts adjacent the front edge of the tray being a locking post; said locking post extending above the front rim of the tray and having side walls that merge with said rim of said tray, a front face that slopes rearwardly of the rim, and a catch opening formed in its front face; said lid being formed with an inwardly extending latch adapted to underlie the upper edge of said catch opening of said locking post and a support lip adapted to overlie the top of said locking post when the cover is closed upon the tray; the latch and support lip being separated by an opening formed in the front face of the cover. The invention will be clearly understood after reference to the following detailed specification read in conjucntion with the drawings.

Figure 1:
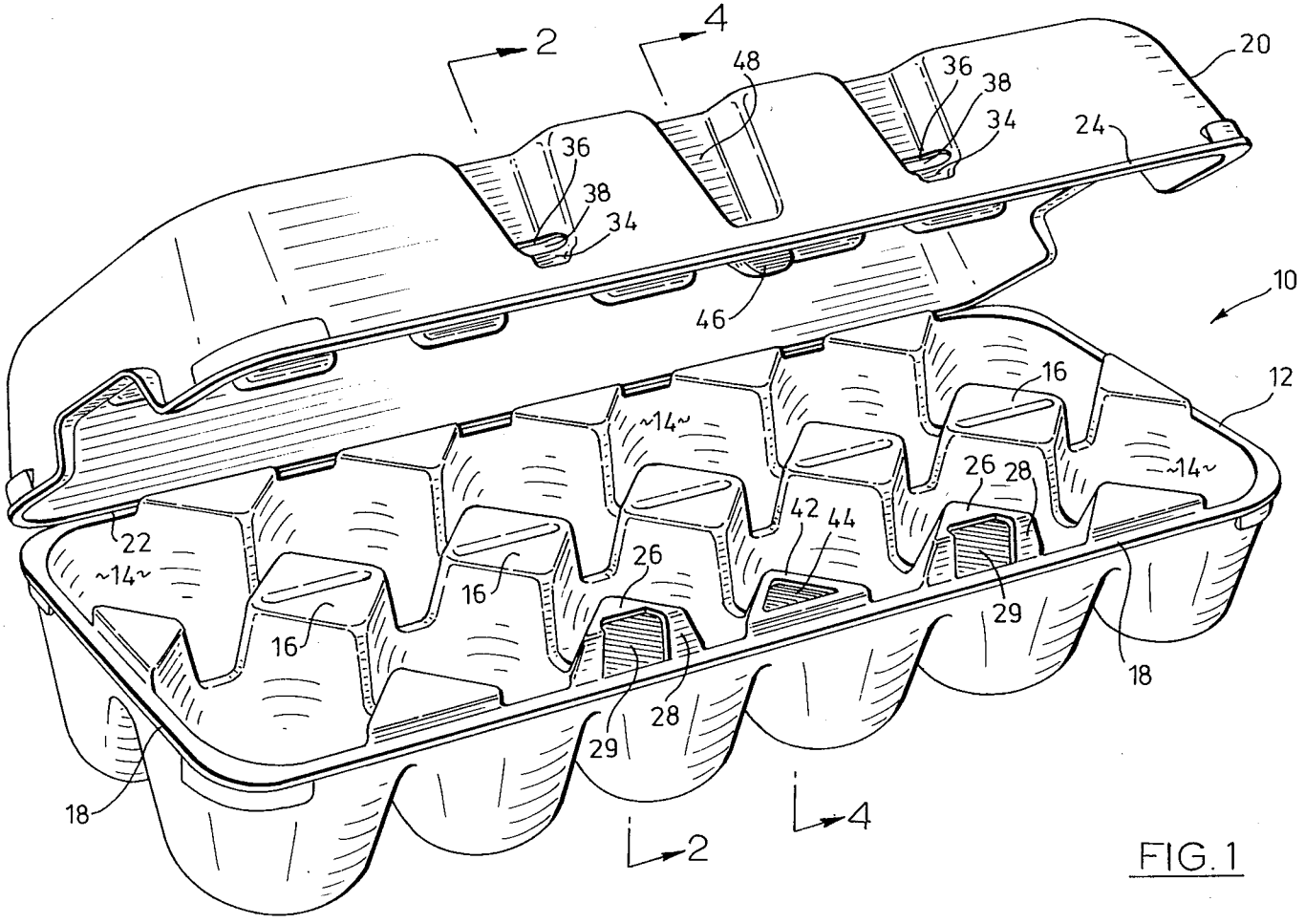
FIG. 1 is a perspective illustration of a container for one dozen eggs according to the invention.
Figure 2:
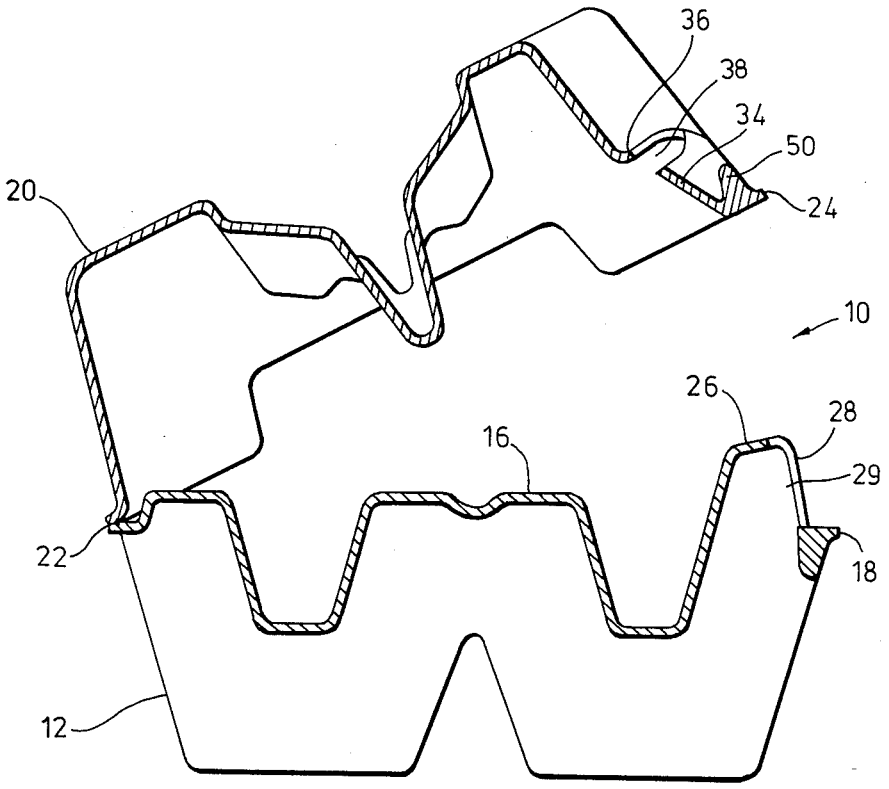
FIG. 2 is an illustration along the line 2—2 of FIG. 1.

Referring to the drawings, the numeral 10 generally refers to a container according to the invention. The container has a tray 12 formed with rows of cavities 14 which are of lesser cross section adjacent their bottom than their top whereby the outside walls of adjacent cavities merge in hollow posts 16 therebetween. The tray has a continuous rim 18 along its front and side edges. In the embodiment of the invention illustrated the rim 18 is straight.

Figure 3:
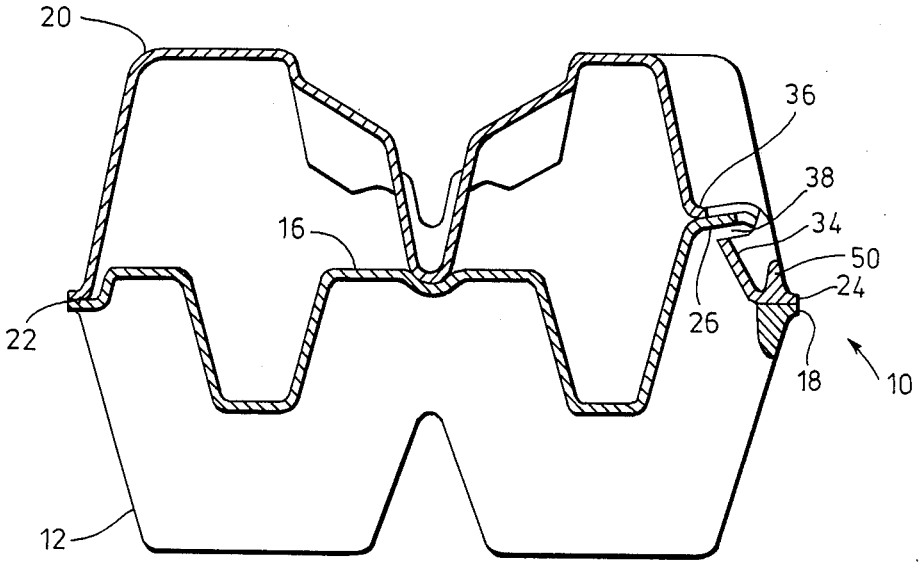
FIG. 3 is an illustration similar to FIG. 2, but showing the container closed.
Figure 4:
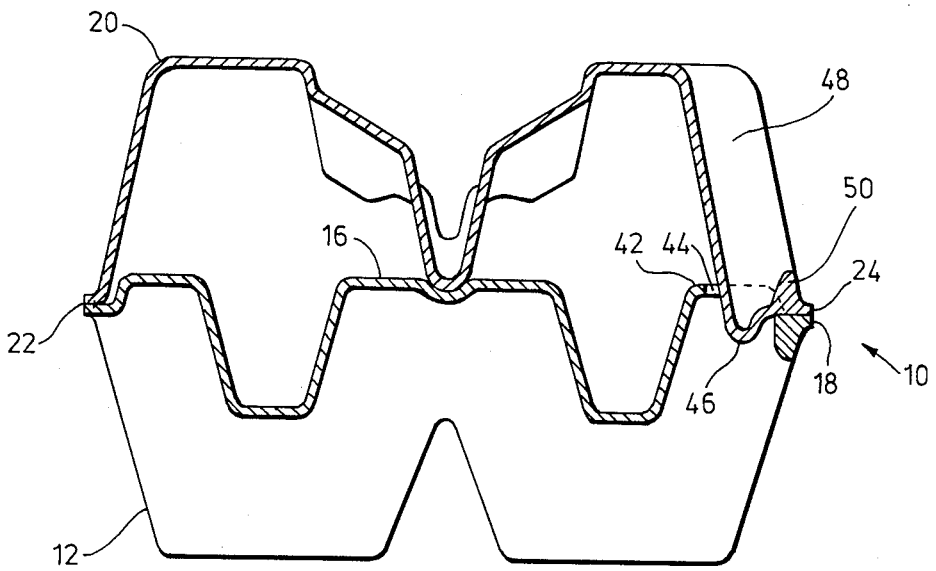
FIG. 4 is an illustration through the location of 4—4 of FIG. 1, but showing the container closed.

The cover 20 is hinged to the tray along the hinge line 22 and also has a continuous rim 24 along its front edge. It will be noted that the continuous rim of the cover meets the continuous rim of the tray when the cover is closed upon the tray as illustrated in FIG. 3 and FIG. 4. It will also be noted that in the embodiment of the invention illustrated that the elevation of the hinge line 22 is the same as the elevation of the continuous rim along the front edge of the tray.

The hollow posts between the cavities along the front edge of the tray are in the nature of half-posts. In the embodiment illustrated, two of these hollow posts, each identified by the numeral 26, are locking posts. It will benoted that the locking posts 26 extend above the front rim 18 of the tray 12 and have side walls that merge with the rim of the tray. They have a front face 28, the plane of which slopes rearwardly of the rim. The front face of the posts 26 in the embodiment of the invention illustrated is substantially all of catch opening 29.

These containerse in the case of a moulded pulp tray are moulded on a foraminous mould, preferably with the outside surface of the tray and of the cover against the mould and according to customary moulding practice for moulding egg trays from pulp. The catch opening 29 in the tray is formed in the moulding process by a deckle that extends upwardly from the surface of the mould and through the moulded post whereby to prevent moulding material from forming at the location of the catch opening on the front face of the locking post. The prinicipal axis of the catch opening is one that extends through the opening and intersects the plane of the bottom of the tray. An opening of this characteristic will permit the extension of the deckle through the post in the moulding operation and permit easy removal of the container from the mould and deckle.

The lid 20 is formed with an inwardly extending latch 34 that is adapted to underlie the upper edge of the catch opening 28 of the locking post 26 when the cover is closed upon the tray as illustrated in FIG. 3. The lid also has a support lip 36 that is adapted to overlie the top of the locking post when the cover is closed upon the tray also as illustrated in FIG. 3.

The latch and support lip are separated by a deckle formed opening 38 in the front face of the cover.

Opening 38 has a prinicipal axis 40 that extends therethrough and intersects the plane of the top of the cover. This alignment of opening and cover plane permits formation of the opening with a deckle and ready removal of the cover from the mould in the moulding process as explained in association with the tray.

There is an anchor post identified by the numeral 42 between the locking posts 26. This post has a deckle formed opening 44 in its top surface to receive the boss 46 that extends downwardly of the principal plane of the bottom of the cover so that when the container is closed the boss enters into the opening and gives rigidity to the container at the location of the continuous rim when the container is closed. The closed position of the container and the interlocking of the boss in the opening in the post is illustrated in FIG. 4. Boss 46 requires for its formation a frontal depression 48 in the front wall of the cover 20. The central anchor post and its associated interlocking boss stabilize the cover and tray wall against relative forward movement under conditions of loading. One can also conveniently open the container by lifting the lid upwardly and outwardly with the tab 50 at the location of the boss. Lifting upwardly and outwardly at the tab in this way will release the interlocking relation at the locking posts. Alternatively, one can open the container by gripping the cover at a locking post and pulling outwardly and upwardly to release the locking engagement. The tab 50 can be gripped at the location of a locking post or of the locking boss.

The invention has been described for pump moulded products. It is equally applicable to plastics moulded products. Embodiments other than the one shown will be apparent to those skilled in the art and it is not intended that the specification should be read in a limiting sense.

What I claim as my invention is:

1. A moulded container for frangible articles comprising:

a tray formed with rows of cavities;

a cover hinged to the tray along a hinge line, the cavities being a lesser cross section adjacent their bottom than their top whereby the outside walls of the adjacent cavities merge in rigid hollow posts therebetween;

said tray having a continuous rim along its front edge;

said cover having a continuous rim along its front edge, the continuous rim of the cover meeting the continuous rim of the tray when the cover is closed upon the tray;

at least one of said rigid hollow posts adjacent the front edge of the tray being a locking post;

said locking post extending above the front rim of the tray and having side walls that merge with said rim of said tray and with the cavities of the tray, a front face that slopes rearwardly of the rim, and a catch opening formed in its front face;

said lid being formed with an inwardly extending latch adapted to underlie the upper edge of said catch opening of said locking post and a support lip adapted to overlie the top of said locking post when the cover is closed upon the tray;

the latch and support lip being separated by an opening formed in the front face of the cover.

2. A moulded container as claimed in claim 1 in which said rim of the front edge of the tray is straight.

3. A moulded container as claimed in claim 2 in which said rim of the front edge of the tray is of the same elevation as said hinge line.

4. A moulded container as claimed in claim 1 in which said latch and said support lip are formed on a depression in the front wall of said cover, said depression having a wall that is channellar in cross section and that slopes rearwardly from the elevation of the front rim towards the top of the cover;

a lifting tab formed on said rim on the front edge of said cover and said lifting tab extending across the bottom part of said depression in the front wall.

5. A moulded container as claimed in claim 2 in which said latch and said support lip are formed on a depression in the front wall of said cover, said depression having a wall that is channellar in cross section and that slopes rearwardly from the elevation of the front rim towards the top of the cover;

a lifting tab formed on said rim on the front edge of said cover and said lifting tab extending across the bottom part of said depression in the front wall.

6. A moulded container as claimed in claim 3 in which said latch and said support lip are formed on a depression in the front wall of said cover, said depression having a wall that is channellar in cross section and that slopes rearwardly from the elevation of the front rim towards the top of the cover;

a lifting tab formed on said rim on the front edge of said cover and said lifting tab extending across the bottom part of said depression in the front wall.

7. A moulded container as claimed in claim 1 having an alignment boss extending downwardly of said rim on the front edge of said cover, a recess in said tray to accept said alignment boss when the cover is closed on the tray.

8. A moulded container as claimed in claim 2 having an alignment boss extending downwardly of said rim on the front edge of said cover, a recess in said tray to accept said alignment boss when the cover is closed on the tray.

9. A moulded container as claimed in claim 3 having an alignment boss extending downwardly of said rim on the front edge of said cover, a recess in said tray to accept said alignment boss when the cover is closed on the tray.

10. A moulded container as claimed in claim 1 having an alignment boss extending downwardly of said rim on the front edge of said cover, a recess in said tray to accept said alignment boss when the cover is closed on the tray;

said latch and said support lip, and said alignment boss, each being formed on a depression in the front wall of said cover, said depressions each having a wall that is channellar in cross section and that slopes rearwardly from the elevation of the front rim towards the top of the cover; a lifting tab formed on said rim on the front edge of said cover and said lifting tab extending across the bottom part of said depressions in the front wall.

11. A moulded container as claimed in claim 2 having an alignment boss extending downwardly of said rim on the front edge of said cover, a recess in said tray to accept said alignment boss when the cover is closed on the tray;

said latch and said support lip, and said alignment boss, each being formed on a depression in the front wall of said cover, said depressions each having a wall that is channellar in cross section and that slopes rearwardly from the elevation of the front rim towards the top of the cover; a lifting tab formed on said rim on the front edge of said cover and said lifting tab extending across the bottom part of said depressions in the front wall.

12. A moulded container as claimed in claim 3 having an alignment boss extending downwardly of said rim on the front edge of said cover, a recess in said tray to accept said alignment boss when the cover is closed on the tray;

said latch and said support lip, and said alignment boss, each being formed on a depression in the front wall of said cover, said depressions each having a wall that is channellar in cross section and that slopes rearwardly from the elevation of the front rim towards the top of the cover; a lifting tab formed on said rim on the front edge of said cover and said lifting tab extending across the bottom part of said depressions in the front wall.

* * * * *